United States Patent [19]

Kuratani

[11] Patent Number: 4,719,324

[45] Date of Patent: Jan. 12, 1988

[54] ROTARY VARIABLE RESISTOR WITH SHAFT RETAINING SPRING MEMBER

[75] Inventor: Junichi Kuratani, Miyagi, Japan

[73] Assignee: Alps Electric Co., Ltd., Japan

[21] Appl. No.: 926,367

[22] Filed: Oct. 31, 1986

[30] Foreign Application Priority Data

Nov. 6, 1985 [JP] Japan ..... 60-169742[U]

[51] Int. Cl.[4] ..... H01H 19/00

[52] U.S. Cl. ..... 200/11 R; 200/336

[58] Field of Search ..... 200/11 R, 11 A, 11 E, 200/11 EA, 11 D, 11 DA, 11 G, 11 J, 11 K, 14, 295, 296, 336; 74/527

[56] References Cited

U.S. PATENT DOCUMENTS

| | | | |
|---|---|---|---|
| 1,624,374 | 4/1927 | Swoboda | 200/11 EA |
| 2,091,471 | 8/1937 | Douglas | 200/11 J |
| 3,258,547 | 6/1966 | Rector | 200/11 A |
| 3,411,377 | 11/1968 | Golbeck | 200/296 X |
| 3,728,511 | 4/1973 | George et al. | 200/296 X |
| 3,924,185 | 12/1975 | Schwartz | 200/11 G X |
| 4,623,763 | 11/1986 | Krause | 200/11 K |

*Primary Examiner*—J. R. Scott

*Attorney, Agent, or Firm*—Guy W. Shoup

[57] ABSTRACT

A rotary type electronic device has a casing, a rotatable operating shaft with one end disposed through a front wall into the casing, a rotary electronic unit in the casing including a rotatable slider retainer which is engaged with the end of the operating shaft, a fastening member fixed on the end of the shaft and engaging the slider retainer, and a spring washer compressed between the fastening member and the casing front wall. The spring water is secured non-rotatively to the fastening member, engages an inner groove on the shaft to hold the shaft axially through the front wall of the casing, and has a protrusion on an annular spring part bearing against the front wall of the casing to provide a click feeling with rotation of the shaft.

1 Claim, 7 Drawing Figures

ROTARY VARIABLE RESISTOR WITH SHAFT RETAINING SPRING MEMBER

BACKGROUND OF THE INVENTION

1. Field of the Invention

The present invention relates to rotary type electronic parts such as, for example, rotary type variable resistors and rotary switches.

2. Description of the Prior Art

As an example of the rotary type electronic parts, there is for example a rotary type variable resistor hereinafter to be referred to as a volume as shown in FIG. 7. Referring to the drawing, the rotary device primarily consists of a case 4 formed of a front plate 1, a back plate 2, and a side plate 3 sandwiched therebetween, a rotary shaft 5 passing through parts from the front plate 1 to the back plate 2, sliders 6 as devices on the rotary side to be rotated by the rotary shaft 5, and substrates 8 provided with conductive patterns 7 as devices on the stationary side, with which the sliders 6 slidably contact.

Of the mentioned case 4, the front plate 1 is provided, on the operating side 5*a* of the rotary shaft 5, with a screwed portion 1*e* for fitting the same to a housing or the like, and on the side of the back plate 2 of the same, there is provided a recessed portion in which a slide member 9 with an annular spring 9*a* for providing necessary rotating torque mounted thereon can be inserted, the spring 9*a* being in slidable contact with the slide member 9. And, the slide member is mounted in the recessed portion 1*d* with the rotary shaft 5 passing therethrough. Further, a slider retainer 10 provided with the sliders 6 on both sides thereof together with the substrates 8, which are provided thereon with the conductive patterns 7 on the sides facing the sliders 6, are passed through by the mentioned slide member 9 and the rotary shaft 5, and integrated with the front plate 1, by the back plate 2 disposed in the rear of the substrate 8 on the left side in the drawing, by means of pins which are not shown. And further, an E ring 11 is fitted into a groove 5*b* provided in the end portion of the rotary shaft 5 on the side of the back plate 2, whereby the slider retainer 10 is integrally fixed to the rotary shaft 5. Denoted by 12 are terminals connected with the conductive patterns 7.

In the assembling of the above mentioned rotary device, the front plate 1 and the slide member 9 are put on the rotary shaft 5 from the rear end of the rotary shaft 5 in the order mentioned, then the spring 9*a* and the substrate 8 on the right side in the drawing are put on the shaft portion of the slide member 9, and then the slider retainer 10 is put on the rotary shaft 5. Thereafter, the E ring 11 is pressed from the side face into the groove 5*b* formed in the rotary shaft 5, whereby the rotary shaft 5 is made not to slip out of the slider retainer 10. In this case, the dimension between the fitted position of the E ring 11 and the stepped portion 5*c* of the rotary shaft 5 is precisely finished so that the component parts from the front plate 1 to the slider retainer 10 may be supported therein without a play, and thereby the rotating torque and the sliding pressure of the sliders 6 are regulated to be proper values and operability and precision in the operation are secured.

After, the side plate 3 regulating the distance between both the substrates 8 is inserted therebetween, the substrate 8 on the left side is put on the slider retainer 10 with a clearance, and pins, not shown, are inserted between the front plate 1 and back plate 2 and fixed by caulking with the back plate 2 pressed against the substrate 8 from the rear side.

In the prior art devices of the above described construction, there was a problem that efficiency in the assembling was bad because the E ring 11 had to be fitted into the groove 5*b* in the rotary shaft 5 with itself tightly abutted on the slider retainer 10 to secure operability and accurate operation, and also, because the small component parts had to be put on the rotary shaft 5 one after the other. And, since all the component parts had to be put in between the stepped portion 5*c* of the rotary shaft 5 and the E ring 11 with precision, each part had to be finished with high accuracy and this led to increase in the costs of the parts.

SUMMARY OF THE INVENTION

The present invention was made in view of these problems of the prior art and an object of the invention therefore is to provide a rotary type electronic part which will be efficiently assembled. Another object of the invention is to provide a rotary electronic part which will be able to give high performance without requiring not so high accuracy in the manufacture of the parts and will be inexpensive.

To attain the above mentioned objects, the present invention, in a rotary type electronic part including devices on the rotary side rotating in association with a rotary shaft and devices on the stationary side including such as conductive patterns and contacts disposed opposite to the devices on the rotary side, is arranged such that an engagement groove is made in the rotary shaft and a fastening member axially put on the rotary shaft elastically engages with the engagement groove at the rear of the front plate which has been put on the rotary shaft, and thereby the front plate is fastened to the rotary shaft, and the devices on the rotary side can be rotatively driven on the side of the end portion of the rotary shaft.

With the above described structure, the fastening member is put on the rotary shaft from the side of the end portion after the front plate has been put on the rotary shaft, an elastic portion of the fastening member is allowed to elastically engage with the engagement groove previously formed in the rotary shaft, and the front plate is fastened to the rotary shaft from behind by means of the fastening member, whereby it is made possible to make the rotary shaft integral with the front plate in advance. Thus, the end portion side of the rotary shaft can be coupled with a subassembly of the devices on the stationary side and devices on the rotary side by making the end portion side of the rotary shaft integrally engaged with a rotary member which supports the devices on the rotary side, and the assembly work can thus be made quite simple.

BRIEF DESCRIPTION OF THE DRAWINGS

FIGS. 1 to 6 are for explanation of the embodiment of the present invention, wherein FIG. 1 is a cross-sectional drawing of a rotary device according to the present embodiment;

FIG. 2 is an exploded perspective view for indicating relations between a rotary shaft, washer, and a fastening plate;

FIG. 3 is rear view of a front plate in the state the front plate is made integral with the rotary shaft;

FIG. 4 is a front view of the washer;

FIG. 5 is a side view of the same;

FIG. 6 is a plan view of the same; and

DESCRIPTION OF THE PREFERRED EMBODIMENT

A preferred embodiment of the present invention will be described in the following with reference to the accompanying drawings.

Figure 1:
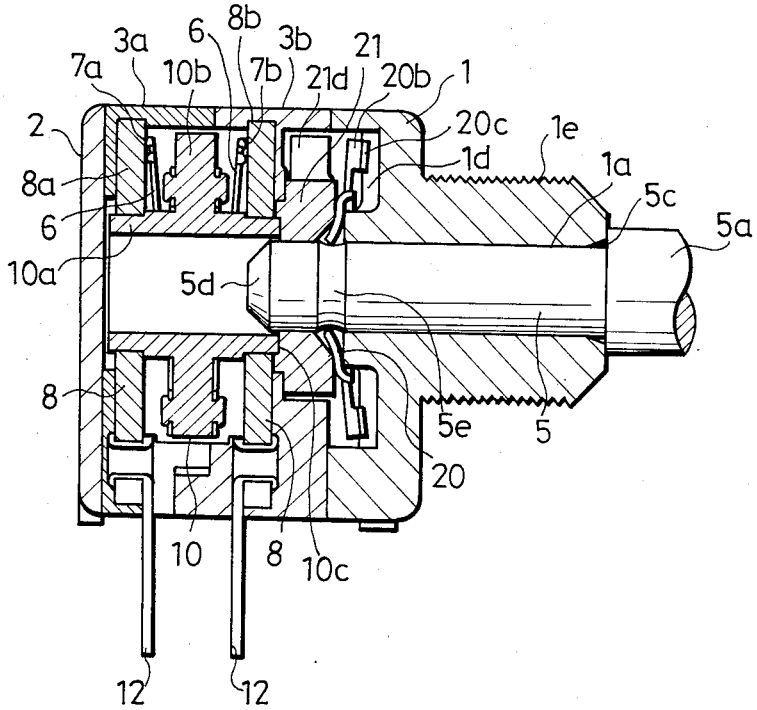
Figure 2:
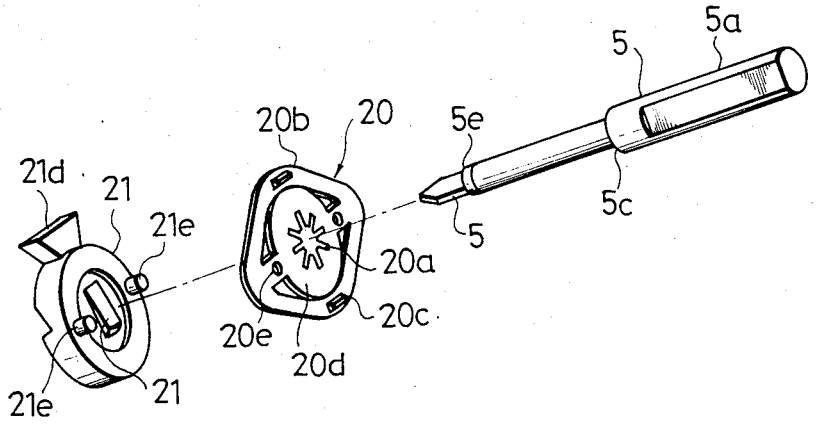
Figure 3:
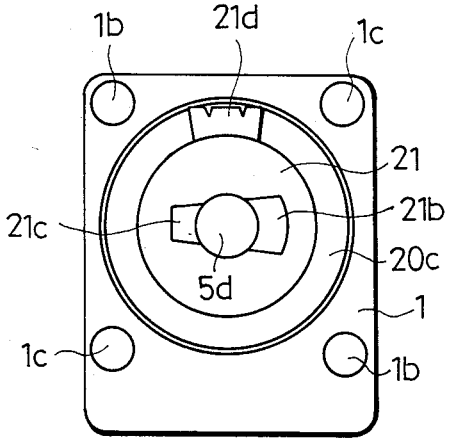
Figure 4:
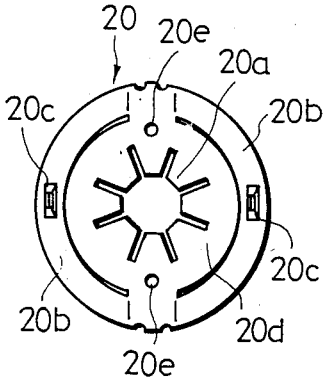
Figure 5:
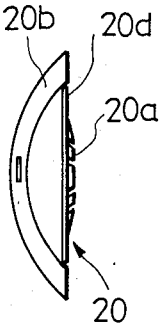
Figure 6:
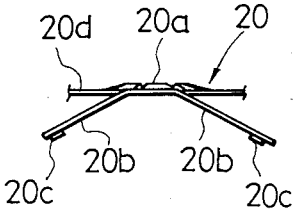
Figure 7:
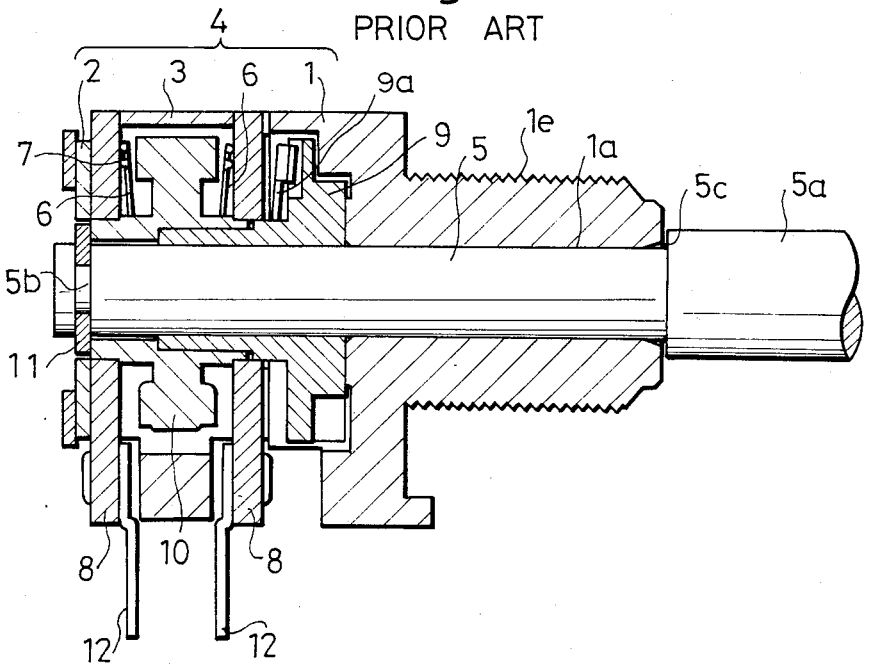
Fig.7 PRIOR ART
FIG. 7 is a cross-sectional view of a rotary device of the prior art.

FIGS. 1 to 6 are for explaining a rotary device according to the present embodiment, in which FIG. 1 is a vertical cross-sectional view of the volume, FIG. 2 is an exploded perspective view indicating a rotary shaft, fastening member, and a fastening plate, FIG. 3 is a rear view indicating a partially fabricated item of a front panel attached to the rotary shaft, FIG. 4 is a front view of the fastening member, FIG. 5 is a side view of the same, and FIG. 6 is plan view of the same. Throughout the drawings, the components the same as or regarded as the same as those of the previously described prior art are denoted by the same reference numerals.

With reference to the drawings, the rotary type electronic part primarily consists of a front plate 1 integrally fitted to a rotary shaft 5 by way of a washer 20 as a fastening member, two substrates 8*a*, 8*b* in which a cylindrically formed shaft portion 10*a* of a slider retainer 10 is rotatably inserted with a clearance, side plates 3*a*, 3*b* for regulating the distance between both the substrates 8, and a back plate 2 positioned on the rear side of the side plate 3*a*, and the mentioned integrally fitted front plate 1 and the back plate 2 with all the above mentioned parts sandwiched therebetween are passed through by pins, not shown, which are caulked so that the whole is integrated.

The rotary shaft 5 is provided on its side of the end portion 5*d* with an engagement groove 5*e* with which an elastic engagement portion 20*a* of the washer 20 engages in a tightly fitted manner, and the distance between the stepped portion 5*c* and the engagement groove 5*e* is adapted to be substantially the same as the length of the through hole 1*a* in the front plate 1 for passing the shaft therethrough. The end portion 5*d* of the rotary shaft 5 is extended from the engagement groove 5*e* by the length necessary for supporting a later discussed fastening plate 21.

The front plate 1 is provided with a threaded portion for the purpose of fitting in the same manner as in the prior art on the operating side 5*a* on the front end side of the rotary shaft 5 and with a recessed portion 1*d* on its rear side on which spring portions 20*b* of the washer 20 slides. There are provided protruded portions 1*b* for the purpose of positioning and through holes 1*c* for passing the pins therethrough at the corner portions on the diagonal lines on the rear side as indicated in FIG. 3.

The washer 20 is formed in a body of a spring material, and as indicated in FIGS. 4, 5 and 6, provided at its central portion with an elastic engagement portion 20*a*, into which the rear end portion 5*d* of the rotary shaft 5 can be fitted and, after the fitting in, the same is prevented from coming off by virtue of the engagement portion 20*a* which then engages with the engagement groove 5*e* of the rotary shaft 5, and provided at its circumferential portion with the annular spring portions 20*b*, which are crescent-shaped and provided with protrusions 20*c* protruded at the most projected portion thereof for the purpose of providing a click feeling. And, at the disk portion 20*d* of the washer 20, there are provided positioning holes 20*e* for regulating the position of the fastening plate 21 relative to the washer 20.

Although the protrusions 20*c* are formed to provide a click feeling in the present embodiment, it goes without saying that only the elastic portion 20*a* with a smooth surface is required for providing necessary torque if the click feeling is not needed.

The fastening plate 21 supports the washer 20 from behind against the front plate 1 for making uniform the force exerted on the washer 20 thereby to prevent the washer 20 from being deformed, and, at the same time, regulates the relative positioning between the slider retainer 10 and the rotary shaft 5 by means of large and small protrusions 21*b*, 21*c* symmetrically provided on the circumference of a through hole 21*a* which is formed in a square shape, and further makes the slider retainer 10 to be rotatable through the protrusions 21*b*, 21*c*. The protrusion 21*d* protruding from the circumference of the fastening plate 21 is for regulating the angle of rotation of the rotary shaft 5, which is adapted to abut against a protrusion, not shown, inwardly protruding from the side plate 3*b*, whereby the angle of rotation is limited within a predetermined range. The two small protrusions 21*e* protruding from the fastening plate 21 toward the side of the washer 20 as shown in FIG. 2 are to be fitted into the above mentioned positioning holes 20*e* made in the washer 20, and the fastening plate 21 and the washer 20 are integrated by tight fitting of the former in the latter.

The slider retainer 10 is provided with a cylindrically formed axial portion 10*a* at its central portion, into which the end portion 5*d* of the rotary shaft 5 is to be fitted with a clearance. In the center of the axial portion 10*a*, there is provided a disk-formed retaining portion 10*b* for retaining sliders 6 as devices on the rotary side, and the sliders 6 are outwardly attached to both sides of the retaining portion 10*b*. And, at the end portion 10*c* of the axial portion 10*a* on the side of the fastening plate 21, there are provided fit grooves to fit on the previously mentioned protrusions 21*b*, 21*c*.

The side plates 3*a*, 3*b* support the substrates 8*a*, 8*b*, respectively, and regulate the distance between both the substrates 8*a*, 8*b*. On the surfaces of the substrates 8*a*, 8*b* facing the above mentioned sliders 6, namely, on their internal surfaces, there are formed conductive patterns 7*a*, 7*b*, respectively, as devices on the stationary side with which the sliders 6 slidably contact. The sliders 6 are adapted to be slidable within the rnage corresponding to the above mentioned rotating range of the rotary shaft 5 whereby desired changes in resistance values are obtained. The side plates 3*a*, 3*b* are provided with protrusions and fit holes corresponding to each other, not shown, so that these members are correctly positioned. The side plate 3*b* on the side of the front plate 1 is provided therein with positioning holes into which the previously mentioned protrusions 1*b* are to be tightly fitted, and further, both the side plates 3*a*, 3*b* are provided with holes for inserting pins therethrough in the positions corresponding to the above mentioned through holes 1*c* made in the front plate 1 and adapted such that the integration is achieved by passing pins therethrough from the front plane 1 to the back plate 2 and caulking the same.

With the described structure, if the front plate 1 is put on the rotary shaft 5 and, after that, the washer 20, with its positioning holes 20*e* fitted on the protrusions 21*e* of the fastening plate 21, is put on the rotary shaft 5 and the elastic engagement portion 20*a* is allowed to elastically engage with the engagement groove 5d, then it is made possible to attach the front plate 1 to the rotary shaft 5 with the rotary shaft 5 rotatably integrated with the front plate 1 in advance with the elastic engagement portion 20a elastically pushing the front plate 1 toward the operating side 5a and the spring portion 20b elastically pushing the front plate 1 toward the operating side 5a. Hence, by preparing partially fabricated items of the front plate 1 integrated with the rotary shaft 5 by way of the washer 20 as above, and separately preparing items on the case side by incorporating the substrate 8a, slider retainer 10, and the substrate 8b with the back plate 2, and then fitting the integrated front plate 1 to the item on the case side by means of the pins, a rotary device can be assembled quite simply.

According to the above described embodiment, since the partially fabricated items can be prepared by allowing the washer 20 to elastically engage with the engagement groove 5e formed in the rotary shaft 5 thereby to integrate the front plate 1 with the rotary shaft 5, the effect is obtained that the assembling work is made quite simple and the assembly cost can be reduced.

Also, the effect is obtained to improve the operability by providing an elastic portion 20a for providing a feel of torque resistance to rotation of the shaft or protrusions for providing a click feeling on the circumference of the washer 20. In addition thereto, reduction in the number of parts can be achieved by enabling a single member to serve both to regulate the rotation of the rotary shaft 5 and to provide torque.

Furthermore, by virtue of the arrangement of tight fitting in the washer 20 of the fastening plate 21, which presses on the washer 20 and also rotatively drives the slider retainer 10, reliability on the products and workability of the same can be assured.

Finally, since the front plate 1 can be previously integrated with the rotary shaft 5, the number of steps of the side of the slider 6 can be arbitrarily selected and thus it becomes possible to use common parts. And, since a play due to dimensional error can be absorbed by the elastic force in the axial direction of the washer 20, the dimension between the stepped portion 5c of the rotary shaft 5 and the engagement groove 5e or that of the substrate 8a, 8b or the slider retainer 10 need not be made so accurate, and therefore the yield rate can be improved and costs of parts can be reduced.

As described so far, according to the present invention in which it is made possible to integrate the front plate with the rotary shaft in advance and then make the assembly work employing the partially fabricated item, efficiency in the assembly work can be improved and parts and assembly costs can be reduced.

What is claimed is:

1. In a rotary type electronic device having a stationary casing including a front wall, a rotatable operating shaft having one end disposed through an opening in the front wall inwardly of the casing and its other operating end disposed outwardly of the casing, and a rotary electronic unit in the casing including a rotatable slider retainer which is engaged with the one end of the operating shaft such that a slider member mounted on the slider retainer is rotated in accordance with rotation of the operating shaft, the improvement wherein said shaft has an inner retaining groove formed between the one end of the shaft and the front wall of the casing, and an outer retaining portion bearing against an outside surface around the opening in the front wall of the casing, wherein the spacing between the inner retaining groove and outer retaining portion is substantially the same as the length along the shaft through the front wall opening;

a fastening member disposed adjacent an inside surface of the front wall of the casing having a central opening shaped to be engaged with the one end of the shaft inserted therethrough, and engaging parts for engaging the rotatable slide retainer to rotate the same in conjunction with rotation of the shaft; and a spring washer disposed between said fastening member and the front wall having elastic engagement portions forming a central opening with a clearance smaller the dimensions of the one end of the shaft, wherein said one end of the shaft is inserted through the central opening by elastically deforming the engagement portions, and the engagement portions become engaged in the inner retaining groove of the shaft to retain the shaft axially through the opening in the front wall, said washer being secured by securing portions non-rotatively to said fastening member, and being tightly pressed by said fastening member against the inner surface of the front wall to provide a feel of torque resistance to rotation of the shaft, and having a protrusion on an annular spring part thereof bearing against the inner surface of the front wall to provide a click feeling in conjunction with rotation of the shaft.

* * * * *